US007526067B2

(12) United States Patent
Ernest et al.

(10) Patent No.: US 7,526,067 B2
(45) Date of Patent: Apr. 28, 2009

(54) ELECTRICAL POWER SUPPLY FOR AN X-RAY TUBE AND METHOD FOR PUTTING IT INTO OPERATION

(75) Inventors: Philippe Ernest, Gif sur Yvette (FR); Georges William Baptiste, Buc (FR)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/970,647

(22) Filed: Jan. 8, 2008

(65) Prior Publication Data

US 2008/0170667 A1 Jul. 17, 2008

(30) Foreign Application Priority Data

Jan. 16, 2007 (FR) ..... 07 52695

(51) Int. Cl.
*H05G 1/10* (2006.01)
*H05G 1/56* (2006.01)

(52) U.S. Cl. ..... 378/101; 378/114

(58) Field of Classification Search ..... 378/101–104, 378/109–119

See application file for complete search history.

(56) References Cited

U.S. PATENT DOCUMENTS

| | | | | | |
|---|---|---|---|---|---|
| 3,663,942 | A | | 5/1972 | Jakobsen | |
| 3,939,352 | A | * | 2/1976 | Mester | 378/109 |
| 4,370,752 | A | * | 1/1983 | Furuichi et al. | 378/110 |
| 4,646,338 | A | * | 2/1987 | Skillicorn | 378/110 |
| 4,928,295 | A | * | 5/1990 | Tanaka | 378/104 |
| 5,034,973 | A | | 7/1991 | Ishiyama | |
| 5,067,143 | A | * | 11/1991 | Watanabe et al. | 378/110 |

FOREIGN PATENT DOCUMENTS

| | | | |
|---|---|---|---|
| EP | 0592164 | A | 4/1994 |
| EP | 0933980 | A | 8/1999 |
| FR | 2398429 | A | 2/1979 |
| FR | 2682830 | A | 4/1993 |
| JP | 56032700 | A | 4/1981 |

* cited by examiner

*Primary Examiner*—Irakli Kiknadze
(74) *Attorney, Agent, or Firm*—Global Patent Operation

(57) ABSTRACT

An electrical power supply for an X-ray tube comprising a current source, a transformer with a primary circuit and a secondary circuit coupled with a resistor (R), the unit supplying a high-voltage generator provided with an equivalent input capacitor is used, when the generator is powered on, to limit the intensity of the inrush current appearing in the circuit.

9 Claims, 2 Drawing Sheets

ELECTRICAL POWER SUPPLY FOR AN X-RAY TUBE AND METHOD FOR PUTTING IT INTO OPERATION

BACKGROUND OF THE INVENTION

1. Field of the Invention

The field of the invention relates to electrical power supplies generally, and more particularly to an electrical power supply for an X-ray tube and a method of implementing the same. An embodiment of the invention may reduce the intensity of an inrush current appearing when an electrical circuit powering the X-ray tube is turned on. Embodiments of the invention can nevertheless be applied to devices other than X-ray generators.

2. Description of the Prior Art

There are known ways of limiting the appearance of an inrush current by the positioning, between the source and the generator, of a switch as well as a resistor, known as a limiting resistor. This series-connected resistor with a value R restricts the value of the current intensity to the value E/R, E being the value of the rectified current.

The resistor should nevertheless provide for the power throughput needed for the x-ray exposures. It is therefore necessary to find a preliminary compromise value for this resistor.

Furthermore, the resistor remains present throughout the working of the power supply. It therefore induces permanent electrical power consumption.

Another prior art device places a first switch, called a secondary switch, in a series connection with the limiting resistor and in a bypass in order to power the generator directly.

The bypass includes a main switch parallel-connected with the assembly formed by the resistor and the secondary switch. In this case, the secondary switch is closed when the system is started up in order to charge the capacitor of the high-voltage generator.

Then, in a second stage, the main switch is closed while at the same time the secondary switch is opened in order to remove the limiting resistor.

However, in practice, this type of assembly calls for a minimum of operation and safety on the part of the logic circuit in order to control the two switches. For example, this minimum implies that the main contractor should be closed only after the complete charging of the capacitor, that the contractors should not be closed when they are crossed by current, that security should be provided in the event of non-functioning of the main contact.

The logic circuit must also take account of the fact that the power is called up exposure by exposure.

Active switches with a precharging and charge transfer circuit are then used; for example contractors. However, these components are unreliable, relatively complex to implement, and costly.

In the case of a battery power supply, there also exist systems of connection with time-lagged contacts, the first contact setting up the precharging circuit, the second contact then setting up the direct path. This rustic solution has the drawback of producing an arc when the first contact is set up and, above all, of allowing the generator to be permanently powered by the battery (entailing problems of battery discharge, reliability, safety).

What is needed is an apparatus and method configured to limit the appearance and effect of this inrush current to the maximum extent

SUMMARY OF THE INVENTION

Embodiments of the invention are directed to resolving these and other problems advantageously by means of a power supply comprising, between the source and the generator, a passive circuit having a transformer. The transformer comprises a primary circuit series-connected between the power supply source and the high-voltage generator and a secondary circuit, which is connected to a resistor.

Thus, when the source is connected to the generator, at a first stage, the voltage of the source is taken to the terminals of the primary circuit of the transformer. By induction, this same voltage is relayed to the terminals of the secondary circuit.

At this point in time, the resistor placed at the terminals of the secondary circuit has the effect of reducing the intensity of the current in the primary circuit. This intensity is limited by the ratio of the voltage to the value of the resistor, just as in the case of a resistor series-connected between the switch and the generator. It is possible to act on the value of the resistor or, in what amounts to the same thing, on the transformer ratio, to control the value of the inrush current.

In this first phase, the intensity of the inrush current is therefore limited through the limiting resistor placed at the terminals of the secondary circuit of the transformer. This limitation enables the capacitor to get charged at low current.

In a second stage, the transformer gets saturated. The transformer-resistor assembly then become equivalent to a simple loss-free conductive connection and no longer plays a role in the working of the assembly.

Through this transformer coupled with a resistor, an embodiment of the invention enables the powering of the generator while at the same time simply and reliably reducing the appearance of high inrush currents. This supply also has the advantage of costing little and being easy to implement.

The source may be a DC source (battery) or an AC source (main supply). The latter is less simple than the former and will be explained here below.

The charging time is 100 μs, far smaller then the main alternation time of 10 ms at 50 Hz. The transformer is calculated so as to get saturated just after this charging time. It therefore does not come into play during this fraction of time of the main alternation.

An embodiment of the invention therefore is an electrical power supply for an X-ray tube. The electrical power supply includes a low-voltage electrical energy source, and a generator supplied by the low-voltage source and producing a high-voltage DC signal capable of exciting the X-ray tube. The electrical power supply further includes a switch interposed between the low-voltage source and the generator to put the generator into operation. The X-ray tube comprises a transformer, series-connected between the switch and the generator, the transformer being provided with a primary circuit and a secondary circuit with a resistor placed at the terminals of the secondary circuit.

An embodiment of the invention is also a method for putting an electrical power supply into operation for an X-ray tube. The method may include supplying a generator by a low-voltage source; supplying the X-ray tube with a high-voltage DC signal produced by the generator; and prompting a turning-on operation by the switching over of a switch interposed between the low-voltage electrical power supply source and the generator. In an embodiment of this method, the x-ray tube includes a primary circuit of a transformer in a series connection between the switch and the generator, and a resistor connected to terminals of the secondary circuit of the transformer.

BRIEF DESCRIPTION OF THE DRAWINGS

Embodiments of the invention will be understood more clearly from the following description with reference to the accompanying figures. The figures are given purely by way of an indication and in no way restrict the scope of the invention. Of these figures.

DETAILED DESCRIPTION

Figure 1:
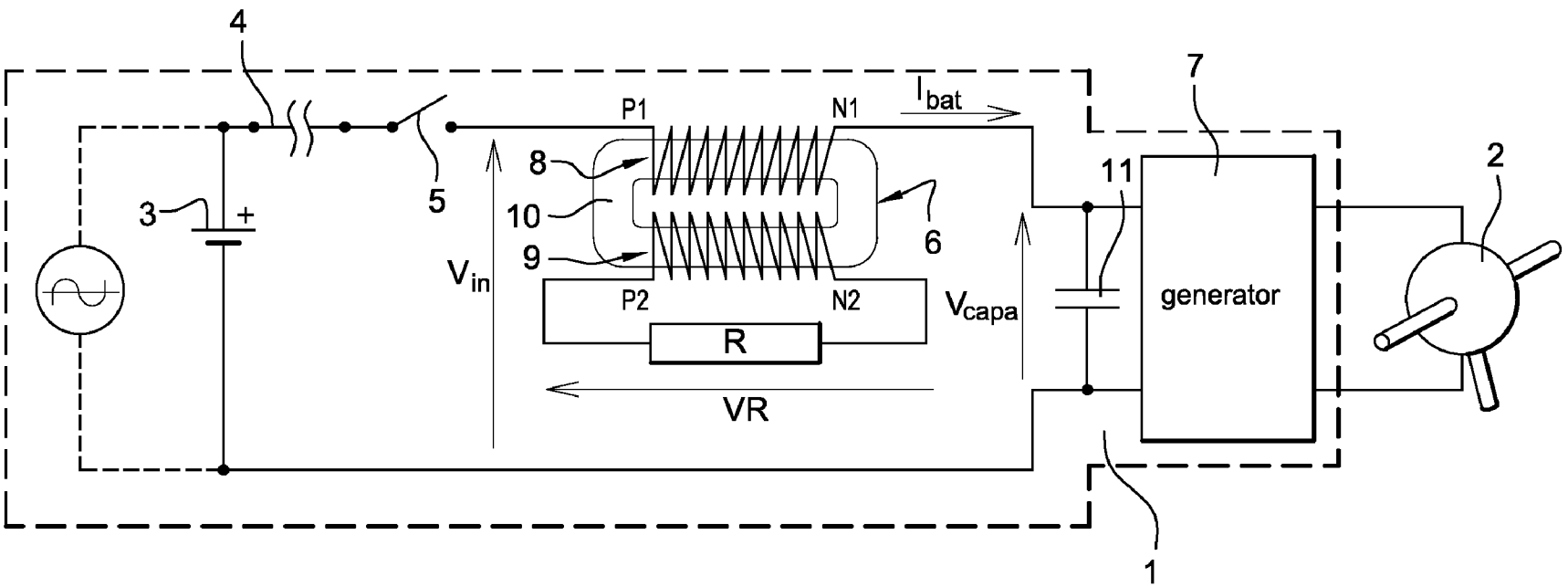
FIG. 1 provides a general schematic view of the electrical power supply of an embodiment of the invention.

FIG. 1 gives a schematic view of the electrical power supply 1 of an embodiment of the invention for an X-ray tube 2.

The supply 1 has a low-voltage source 3 that delivers a DC or an AC voltage Vin.

For example, this low-voltage source produces a 220V DC voltage or 220V RMS AC voltage.

A cable 4 connects the source 3 to the tube 2. The cable 4 may have a free length of about 10 m to enable the tube to be moved from the source 3.

This drawing of the electrical power supply 1 also shows a switch 5 series-connected with a transformer 6 as well as a high-voltage generator 7. In the case of a source 3 that takes the form of a battery, the battery and generator are juxtaposed and both form two parts of the mobile unit.

The transformer 6 has a primary circuit 8 and a secondary circuit 9. The primary circuit 8 is formed by several turns of conductive wire wound about an arm of a magnetic core 10.

The secondary circuit 9 is also formed by turns wound about another arm of the core 10. The two arms are magnetically linked.

To simplify the description, the transformer ratio 6 is taken to be equal to 1. However, it is possible to provide for another ratio, as shall be seen here below.

The input terminal P1 and output terminal N1 of the primary circuit are series-connected between the switch 5 and the generator 7. A resistor R is placed at the input terminal P2 and output terminal N2.

The generator 7 essentially has the following in the order of operation: a current rectifier in the case of an ACt current source, a converter delivering a high-frequency square-wave voltage of the order of 20 KHz to 200 KHz and then a transformer raising the voltage of the square waves. Finally, a rectifier connected to output of the high-frequency transformer delivers the high-voltage DC current.

The generator 7 has filtering capacitors downstream from the rectifier when the instrument is powered by AC current. This is why it is presented here as being supplied with DC current with an equivalent capacitor 11 at input, a voltage Vcapa being measured at the terminals of this capacitor.

Figure 2:
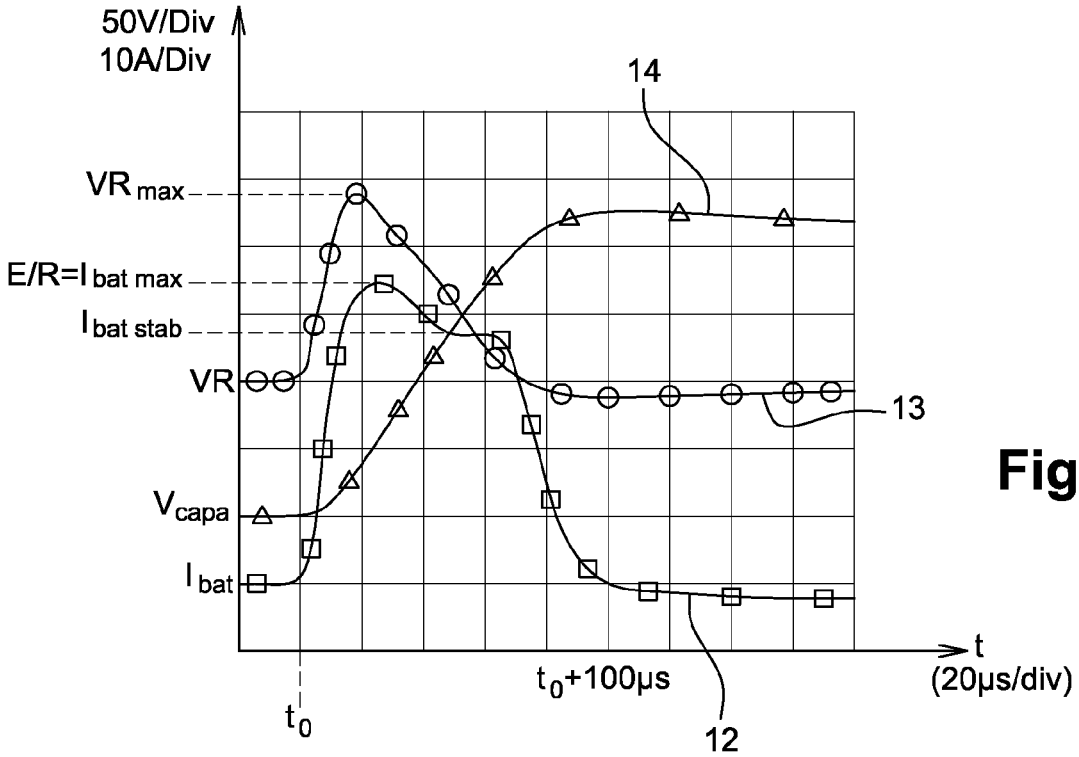
FIGS. 2 and 3 are curves respectively representing the progress of the voltage Vin at the terminals of the source, the voltage VR at the terminals of the resistor of the transformer and the intensity Ibat of current delivered by the source as a function of time t.

The following are shown together in FIG. 2: first of all a curve 12 representing the progress of the intensity Ibat as a function of the time t, then a curve 13 representing the progress of the voltage VR as a function of the time t and a curve 14 representing the progress of the voltage Vcapa as a function of the time t. The graph scales are respectively as follows: on the y-axis, 50 V per division for the voltages and 10 amperes per division for intensity. On the y-axis they represent 20 μs per division on the time scale.

For all the measurements made in FIG. 2, the source 3 in one example is a battery delivering a low-voltage DC current with a value E=220 V, the resistor coupled to the secondary circuit 9 of the transformer 6 has a value R=4.7 ohms and the equivalent capacitance 11 of the generator 7 is C=12.6 μF.

The operating principle of the electrical power supply 1 coupled with the high-voltage generator 7 of the X-ray tube 2 is the following. The generator is powered on by the contractor 5 which is closed at the time t0.

The source 3 then delivers a current with an intensity Ibat flowing in the primary circuit 8 of the transformer 6. The current flowing in the turns of the primary circuit 8 induces a magnetic induction flux within the core 10. In its turn within the secondary circuit 9, this flux generates an electrical current flowing through the resistor R.

Since the transformer 6 has a ratio equal to 1, the voltage present at the terminals P1 and N1 of the primary circuit 8 is found at the terminals P2 and N2 of the secondary circuit 9. The resistor R placed at the terminals P2, N2 of the secondary circuit perceives the voltage (E−Vcapa)/R.

The intensity of the inrush current is then limited to E/R at its highest point, as can be seen on the curve 12. This curve 12 therefore shows a growth of the current Ibat, whose slope is limited chiefly by the leakage inductance of the transformer, until the current reaches its maximum level Ibatmax, smaller than E/R but close to it.

The flux corresponding to the integral by time of the voltage (E−Vcapa) in the core 10 of the transformer 6 increases until saturation. The transformer then gradually loses its property of transmitting electrical power to the register R and therefore of limiting the current, whence the presence of a steady level on the curve 12 for the current Ibat before this current decreases gradually when the capacitor 11 is completely charged. Correspondingly, the voltage VR at the terminals of the resistor R, which can be seen on the curve 13, passes through a maximum value VRmax before getting cancelled out when the current Ibat has decreased.

Thus, the core is properly sized when we start observing this steady level on the curve 12 of FIG. 2 representing Ibat.

If the transformer gets saturated too soon, the DC current continues to rise and goes substantially beyond E/R. if the steady level does not appear, it means that the core can be reduced or else that it is possible to further reduce the inrush current especially, and to do so in a simple way by reducing the number of turns of the secondary winding.

Figure 3:
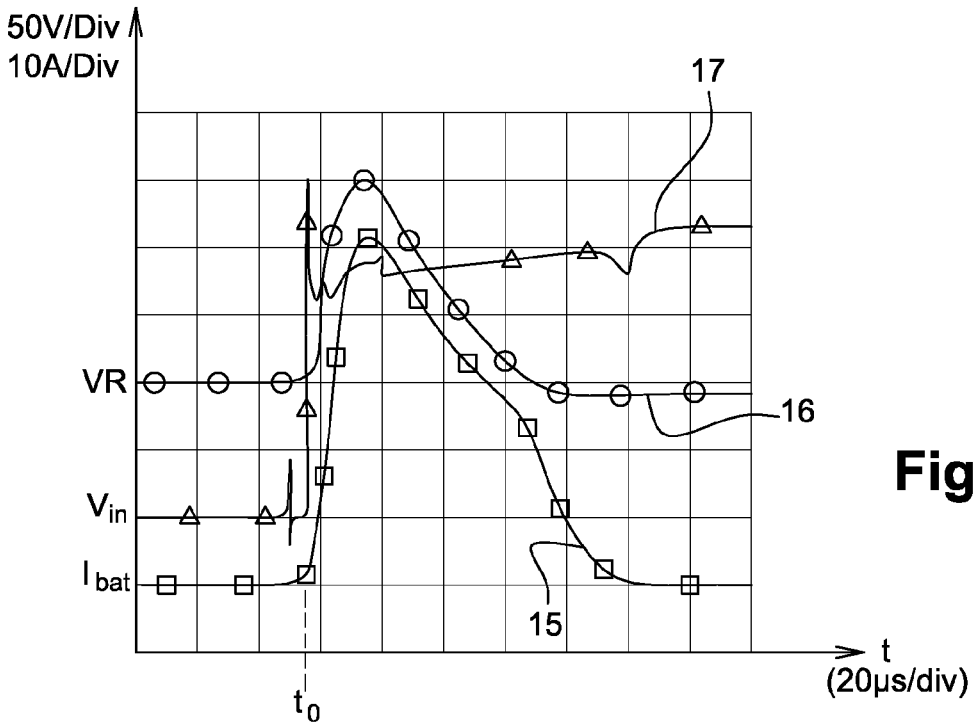

This is illustrated in FIGS. 2 and 3.

For the AC operation, it may be recalled that the core must get saturated quickly.

Depending on the time that elapses, the current flowing in the circuit corresponding to the electrical power supply 1, after passage in the transformer, charges the capacitor 11 corresponding to the high-voltage generator 7 according to a voltage Vcapa.

The voltage Vcapa present at the terminals of the capacitor 11 increases as a function of time until it reaches a maximum value shown on the curve 14 in a straight line substantially parallel to the x-axis for an approximate value of 230 V.

At the end of a period of 40 μs, the core 10 of the transformer 6 gets saturated, taking account of the flux equal to the integral by time of the voltage present at the terminals of the primary circuit and/or secondary circuit, and taking account of the number of turns chosen.

In the example, the power delivered by the generator 7 is in the range of about 20 kW with a power supply source of about 220 V, leading to an operating current of about 100 amperes.

In one given example corresponding to FIG. 2, the number of turns at the primary circuit as well as the secondary circuit is equal to 12 while the resistance is equal to 4.7 ohms.

In another example corresponding to FIG. 3, the number of turns of the secondary circuit 9 goes to 13 while the same resistance value R is kept. The results obtained are identical to those obtained with 12 turns at the primary circuit 8 and secondary circuit 9 but with a resistance value R of 4 ohms. Thus, by having more turns in the secondary circuit 9 or obtaining the passage of greater current intensity by lowering the value of the resistance R, it is possible to saturate the transformer 6 less quickly.

Thus, for a resistor with a value of about 4 ohms or an equivalent of 13 turns on the secondary circuit 9, we obtain an intensity, when closing, of about 52 amperes (200 V on 4 ohms). With a resistance of 4.7 ohms and 12 turns, the current is limited to 44 amperes. A compromise therefore has to be found between the size of the magnetic circuit and the limiting of the inrush current.

In both these examples, the limiting of the inrush current represents about half the intensity of the operating current, i.e. about 50 amperes for 100 amperes respectively.

In FIG. 1, the number of turns is 12 on the primary circuit 8 and 12 on the secondary circuit 9.

The section of the wire of the primary circuit is about 4 $mm^2$ and that of the secondary circuit is about 1 $mm^2$. For, in the case of the transformer used for an embodiment of the invention, it is unnecessary to use a large turn section for the secondary circuit 9, which comes into operation for about 100 microseconds. The resistance of the secondary wire is simply added to the load resistance R.

On the contrary, the turns forming the primary circuit, which come into action after about 100 μs as a simple conductive connection, require a larger section in order to offer as little resistance as possible during the passage of the current to the power generator.

It is therefore judicious to set up a transformer ratio that is appreciably greater than 1.

These magnitudes being given, the size of the core 10 of the transformer 8 is about 10 cm long by 4 to 5 cm wide for a height of about 2 cm. The supply 1 is therefore compact and takes up little space on the mobile. On the given size of this core 10 thus depends the desired charging time constant. Furthermore, the material used for the composition of the core is important. Preferably, a magnetic core with two half cores C will be chosen, using for example iron-silicon sheets with high saturation induction (>2 T) and low remanent induction. To prevent an excessively rapid saturation of the transformer, it is possible of course to increase the number of turns but this is limited by the space, since the section of the wire has to be sufficient to withstand the operating current of the apparatus.

Thus, at the curve 12 of FIG. 2, at the instant t0 when the switch 5 is closed, the intensity Ibat rises regularly in a time span of 20 μs until a maximum value of intensity Ibatmax of 44 amperes. At t0, plus about 50 μs, the value of Ibat encounters a 36-ampere threshold with a duration of about 20 μs.

This steady level of intensity Ibat corresponds in fact to a start of saturation of the core 10 of the transformer 6. This threshold of intensity lasts barely about 20 μs and, 30 μs later, the intensity Ibat recovers its initial value emitted by the source 3.

At t0 plus 100 μs, the core of the transformer is completely saturated. Then, the resistor R no longer acts and the assembly formed by the transformer 6 and the resistor R behaves like a simple conductive connection.

In the same way, on the curve 13 of FIG. 2, the value of the voltage VR on the edge of the resistor is the maximum at about 20 μs to attain a value VRmax of 130 V and then regress regularly to recover its initial value 60 μs later.

During the time interval t0 and t0 plus 100 μs, the capacitor 11 corresponding to the high-voltage generator 7 gets completely charged. This is what is found on the curve 14 of FIG. 2 with a maximum voltage Vcapa of about 220 Volts.

In FIG. 3, the x-axis represents the time t and the y-axis represents the different values of voltage VR and Vin and of intensity Ibat with a scale of 50 V per division and 10 amperes per division respectively.

The curve 15 represents the progress of the intensity of the battery Ibat as a function of the time, the curve 16 shows the progress of the voltage VR at the terminals of the resistor as a function of the time t, and the curve 17 shows the progress of the voltage Vin at the terminals of the source 3 downstream from the switch 5, as a function of the time t.

These respective curves 15, 16 and 17 are obtained for values of the magnitudes E and C, representing the capacitance 11 of the capacitor, identical to those of FIG. 1 described here above but for a resistor R connected to the terminals of the secondary circuit 9 of the transformer 6 with a resistance value equal to 4 ohms.

It can be seen on the curve 15 that, from the instant t0 after which the source 3 is put into operation through the closing of the switch 5, within about 20 μs the intensity reaches a peak value equal to 52 amperes. Then, as in the case of the curve 12, in about 20 μs, the battery intensity Ibat diminishes gradually to reach its initial value.

This value corresponds to the battery intensity Ibat present in the circuit before the instant t0 at which the inrush current appears. On this curve 15 of FIG. 3, unlike in the equivalent of curve 12 of FIG. 2, there is no steady level where, for a period of 20 μs, the intensity gets standardized at a value Ibatstab of about 37 amperes.

This plateau or steady level effect does not appear during the phase of lowering of intensity Ibat on the curve 15, and this is the case for about 80 ms. The intensity then decreases regularly.

On the curve 16 representing the voltage VR at the terminals of the resistor R coupled to the secondary circuit 9 of the transformer 6, starting from the instant t0, the voltage rises in 20 μs to an approximate value of 60 V, this voltage being also slightly higher than the voltage observed on the curve 13 of FIG. 2.

With regard to the curve 17, characterizing the progress of the voltage Vin downstream from the switch 5 at the terminals of the source 3 as a function of the time t, this voltage has a sudden peak at the instant t0 at which the effect of the current inrush appears, and then gets stabilized after the effect of the current inrush fades away, giving a source voltage Vin of about 230 V at the end of 100 to 110 μs.

Between these two points in time, its mean value is 180 volts barring a few small oscillations.

According to an embodiment of the invention, after the capacitor 11 of the generator 7 is charged, the source 3 continues to work and the switch 5 gets closed, the transformer 6 gets completely saturated and the intensity Ibat of the battery is no longer limited by the resistor R.

An embodiment of the invention thus makes it possible, at a first stage, to limit the peak of the inrush current. It also enables the preservation, in a second stage, of an intensity Ibat of the source 3 not limited by a resistor R.

With respect to a 220 volt AC supply source 3, initially designed to work with the generator, the current inrush phenomenon with a 100 μs duration is totally transparent with respect to an AC low-voltage frequency period equal to 20 ms (for a mean frequency of 50 Hertz).

The invention can therefore be used without distinction with a DC source or with an AC source.

The invention can be applied typically to power factor correction input stage DC/AC converters or AC/DC converters. These converters have power values in the 1-100 kW range. At input, they have a decoupling capacitance whose value can be qualified as an average value, ranging typically from 1 to 100 μF. These converters are such that the inrush current when the device is turned on is:

(a) big enough to have to be reduced by a device dedicated to this purpose. An EMC differential mode filtering capacitance would have a typical value of 10 nF to 1 μF, and its inrush current would be simply reduced by the inductances of a filter. Or else, if the apparatus is a low-power apparatus and if the yield aspect is not fundamental, this inrush current would be reduced by a permanent, constant or variable resistance; or (b) not big enough to require a circuit dedicated to this precharging, such as for example contact circuits and precharging resistors generally used with apparatuses with this power.

In this context, the working of an X-ray tube is dictated by the high voltage applied between an anode and a cathode of this tube, as well as by the electrical heating current with which a filament of the cathode is taken to high temperature. The principle of X-ray emission consists in extracting the electrons from the cathode and projecting them at high speed on the anode. The anode target that is struck by these electrons then emits X-rays that can be used to produce radiography exposures or, more generally, radiology images.

Thus, the high voltage applied is directly related to the energy of the X-photons emitted. The hardness of the X-rays depends chiefly on the high voltage prevailing between the anode and the cathode of the tube, the X-ray flow rate for its part depending chiefly on the anode heating current.

Carrying out a radiography operation, and, more generally, a radiology examination, therefore necessitates the emission by the tube, once the patient is placed between the tube and a detector, of irradiation for a short period of about one millisecond, this duration being called an exposure.

Given the homogeneity of the target material of the anode, variations in the supply high voltage during the shot, and the statistical phenomenon of X-ray production, these X-rays are emitted in a wide spectrum.

Furthermore, the nature of the X-rays and their energy depends on the type of image to be made. Certain interposed tissues to be viewed, especially the tissues of the human body, have radiology absorption coefficients that are different for different X-photon energy values. It is therefore known that, in a radiology examination, the practitioner lays down the value of the high voltage.

In order that the image of the tissues analyzed may be calibrated throughout an exposure, it is necessary to have full control over the high voltage and the mean flow rate of the tube during the pulse corresponding to the operating current in the tube. In particular, it is planned that the mean flow rate of the tube during the pulse will be contained in a window of ±10% about the expected mean value.

It is therefore also necessary, upstream, to gain control over the value and stability given to the high voltage delivered by a generator. To this end, a high-voltage generator is provided with power converters generally possessing high capacitance values (in the range of 1 to 100 μF). Others possess even greater capacitance values in the range of 10,000 μF.

In this respect, a distinction is made between an output capacitance of the generator, providing for a low ripple of the high voltage applied to the X-ray tube, and an input capacitance of the generator. It is sometimes true, but not necessarily so, that the input capacitance of the generator must be high so that its output voltage can be well regulated and constant. This is not the case in generators with PFC input.

The input capacitance is used for decoupling so that the power supply to the generator, namely the battery or the AC main system, does not have to deliver high-frequency switched current which would penalize the life expectancy of the battery or pollute the AC power supply system.

The high-voltage generator thus has the task of producing a current having the same direction and the fewest possible fluctuations between the cathode and the anode.

The generator for its part is powered by an AC current source in the case of a fixed device or a source of DC current delivered by a battery, for example in the case of a mobile device.

A generator comprises first of all, and generally, a filter with input capacitances, possibly a current rectifier in the case of an AC current source, a decoupling capacitor and then a DC/AC generator delivering a high-frequency square voltage of the order of 20 KHz to 300 KHz. A step-up circuit raises the voltage of the voltage square wave. Finally, a rectifier delivers a DC voltage downstream.

Now, at the time of the power demand, when the power is turned on, a high current inrush appears. This inrush is linked to the charge of the input capacitors of the input capacitors of the generator.

An embodiment of the invention also comprises a method for putting into operation an electrical power supply 1 for an X-ray tube 2. The method may include supplying a generator 7 by a low-voltage electrical energy source 3. The method may further include supplying the X-ray tube 2 with a DC high-voltage signal produced by the generator 7. The method may further include prompting a turning-on operation by a switching over of a switch 5 interposed between the source 3 and the generator 7. In this method, the x-ray tube may include a primary circuit 8 of a transformer 6 connected in series between the switch 5 and the generator 7, and a resistor R connected to terminals of the secondary circuit 9 of the transformer 6.

According to this method, an automatic step is implemented. This automatic step is that of the saturation of the transformer. This saturation step is equivalent to an opening of a switch, which would be present in the secondary winding, in series with the resistor R.

What is claimed is:

1. An electrical power supply for an X-ray tube, the electrical power supply comprising:

a low-voltage electrical energy source, a generator supplied by the low-voltage source and producing a high-voltage DC signal capable of exciting the X-ray tube and a switch interposed between the source and the generator to put the generator into operation, wherein the X-ray tube comprises a transformer, series-connected between the switch and the generator, the transformer being provided with a primary circuit and a secondary circuit with a resistor (R) placed at the terminals of the secondary circuit.

2. A power supply according to claim 1 wherein the energy source is an AC source.

3. A power supply according to claim 1, wherein the energy source is a DC source.

4. A power supply according claim 1, wherein the transformer comprises a core with high saturation induction (>1T).

5. A power supply according to claim 1, wherein a value of the magnitude of the resistance (R) depends on the value of the current intensity (Ibat) desired when the power supply is turned on (E).

6. A power supply according to claim 1, wherein the number of turns on the primary or secondary circuits depends on the value of the current intensity (Ibat) desired when the power supply is turned on (E).

7. A power supply according to claim 1, wherein a section of a turn of the primary circuit of the transformer is greater than a section of a turn of the secondary circuit.

8. A method for putting into operation an electrical power supply for an X-ray tube, the method comprising: supplying a generator by a low-voltage electrical energy source ; supplying the X-ray tube with a DC high-voltage signal produced by the generator; prompting a turning-on operation by a switching over of a switch interposed between the source and the generator, wherein the x-ray tube comprises:

a primary circuit of a transformer connected in series between the switch and the generator, and a resistor (R) connected to terminals of the secondary circuit of the transformer.

9. A method for putting into operation an electrical power supply for an X-ray tube according to claim 8 wherein a full saturation of the core of the transformer is carried out.

* * * * *

UNITED STATES PATENT AND TRADEMARK OFFICE

CERTIFICATE OF CORRECTION

PATENT NO. : 7,526,067 B2
APPLICATION NO. : 11/970647
DATED : April 28, 2009
INVENTOR(S) : Ernest et al.

It is certified that error appears in the above-identified patent and that said Letters Patent is hereby corrected as shown below:

On the Title Page, in Field (30), under "Foreign Application Priority Data", in Column 1, Line 1, delete "07 52695" and insert -- 0752695 --, therefor.

In Column 1, Line 45, delete "contractor" and insert -- contactor --, therefor.

In Column 1, Line 47, delete "contractors" and insert -- contactors --, therefor.

In Column 1, Line 54, delete "contractors." and insert -- contactors. --, therefor.

In Column 3, Line 48, delete "ACt" and insert -- AC --, therefor.

In Column 4, Lines 8-9, delete "contractor" and insert -- contactor --, therefor.

In Column 7, Line 14, delete "10 nF" and insert -- 10 μF --, therefor.

In Column 8, Line 66, in Claim 4, after "according" insert -- to --.

Signed and Sealed this

Ninth Day of June, 2009

John Doll

JOHN DOLL
*Acting Director of the United States Patent and Trademark Office*